US005975943A

United States Patent [19]

Chou et al.

[11] Patent Number: 5,975,943

[45] Date of Patent: Nov. 2, 1999

[54] CONNECTOR WITH VISUAL INDICATOR

[75] Inventors: Charles Chou, Tu-Chen; Richard Chen, Hsin-Tien, both of Taiwan

[73] Assignee: Hon Hai Precision Ind. Co., Ltd., Taipei Hsien, Taiwan

[21] Appl. No.: 08/959,993

[22] Filed: Oct. 29, 1997

[30] Foreign Application Priority Data

Nov. 29, 1996 [TW] Taiwan ..... 85218574

[51] Int. Cl.[6] ..... H01R 3/00

[52] U.S. Cl. ..... 439/490; 439/676

[58] Field of Search ..... 439/488–490, 439/676, 344

[56] References Cited

U.S. PATENT DOCUMENTS

| | | | |
|---|---|---|---|
| 5,700,157 | 12/1997 | Chung | 439/490 |
| 5,704,802 | 1/1998 | Loudermilk | 439/490 |
| 5,797,767 | 8/1998 | Schell | 439/490 |

*Primary Examiner*—Hien Vu

[57] ABSTRACT

A modular receptacle jack assembly with a visual indication function provides a visual indication when the receptacle jack is connected with a mating plug jack. The modular receptacle jack assembly comprises a modular receptacle jack and an indicator mounted to the jack. The jack includes a housing having a bottom wall for connection to a printed circuit board, a top wall opposite the bottom wall, a front face defining a cavity for receiving the mating plug jack and a rear face opposite the front face, and a number of contacts securely fixed to the bottom wall of the housing and having contact portions extending into the cavity. The indicator includes a base having a first wall attached to the top wall of the housing and a second wall attached to the rear face of the housing and defining holes extending lengthwise therethrough. Diodes are mounted on the base and have leads extending through the holes. A cover has a third wall connected to two side walls extending upward from two ends of the first wall and a fourth wall connected to the second wall. A transparent block is mounted between the first and side walls of the base and the third wall of the cover cooperating therewith to enclose the diodes.

8 Claims, 3 Drawing Sheets

CONNECTOR WITH VISUAL INDICATOR

BACKGROUND OF THE INVENTION

1. Field of the Invention

The present invention relates to an electrical connector device having a visual indicator, and particularly to a modular receptacle jack having a visual indicator to provide a visual indication of a connection formed by the modular receptacle jack with a mating modular plug jack.

2. The Prior Art

A modular receptacle jack with a visual indicator to indicate a connection of the modular receptacle jack with a mating modular plug jack is known. For example, U.S. Pat. No. 4,978,317 discloses a modular receptacle jack having LEDs integrally secured to a housing of the jack. However, such a prior art requires a new mold to form the modular receptacle jack. In accordance with the disclosures of the '317 patent, existing jacks and molds for forming them can not be used to produce the modular receptacle jack having a visual indication function. Such a disadvantage causes an inconvenience and increases costs for modular jack manufacturers since they must alter their original equipment to produce the modular receptacle jacks. Prior to '317 patent, an indicator attached to the existing modular jack has been disclosed to achieve the visual indication function, however, the structure of the indicator and the attaching procedure thereof are relatively complicated. Furthermore, such a modular receptacle jack combined with the indicator is relatively bulky which is undesirable in view of the trend of the electronics industry toward increased compactness.

Hence, a modular receptacle jack with a visual indication function is required which can overcome the problems as mentioned above.

SUMMARY OF THE INVENTION

Accordingly, an objective of the present invention is to provide a visual indicator which can be easily attached to an existing modular receptacle jack to provide the jack with a visual indication function when the receptacle jack is connected with a mating plug jack, whereby the necessity to provide a new mold for integrally securing LEDs to the modular receptacle jack is avoided.

Another objective of the present invention is to provide a visual indicator for a modular receptacle jack wherein the indicator has a simple structure.

A further objective of the present invention is to provide a modular receptacle jack assembly comprising a jack attached with a visual indicator, wherein the assembly is compact in volume.

To fulfill the above-mentioned objectives, according to an embodiment of the present invention, a modular receptacle jack assembly with a visual indication function to provide a visual indication when the assembly is connected with a mating plug jack includes a receptacle jack having a housing with a front face defining a number of cavities for insertion of corresponding plug jacks, a rear face opposite the front face, a bottom wall for attachment to a printed circuit board, and a top wall opposite the bottom wall. An indicator includes a base having a first wall fixedly attached to the top wall of the housing, a second wall attached to the rear face of the housing, wherein the second wall has a number of holes extending therethrough. A number of light-emitting diodes each have two leads respectively extending through two corresponding holes defined in the second wall and fixedly engaged within the second wall. Two side walls are formed upward from two edges of the first wall. A cover has a third wall adjoining top edges of the side walls and a fourth wall contacting the second wall to cooperatively define a space in which the diodes are received. A transparent/translucent block is mounted between the first and side walls of the base and the third wall of the cover to block a front opening of the space in which the diodes are received.

DETAILED DESCRIPTION OF THE PREFERRED EMBODIMENTS

Reference will now be made in detail to the preferred embodiment of the present invention.

Figure 1:
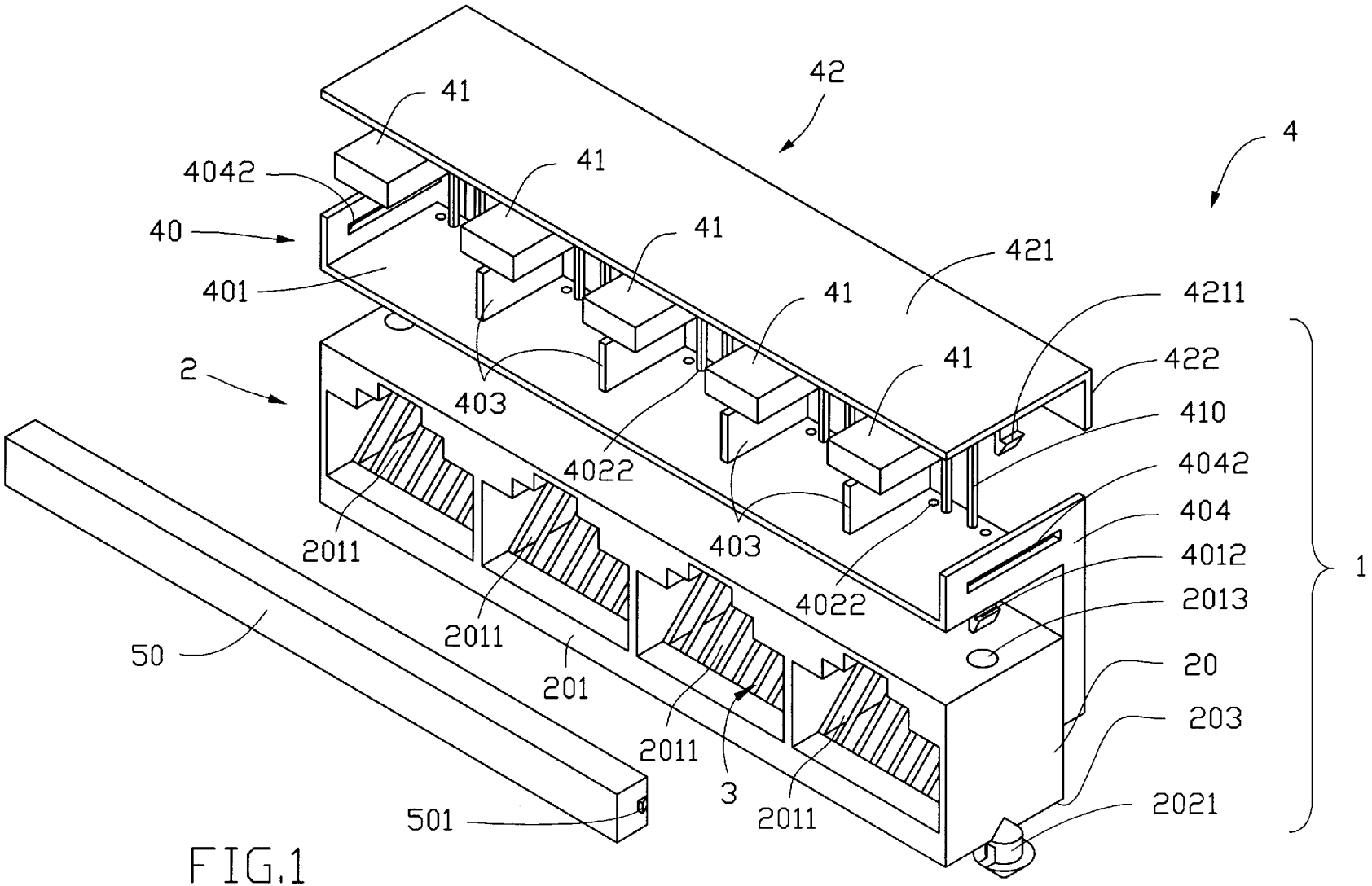
FIG. 1 is an exploded perspective view showing components constituting a modular receptacle jack assembly in accordance with the present invention.
Figure 2:
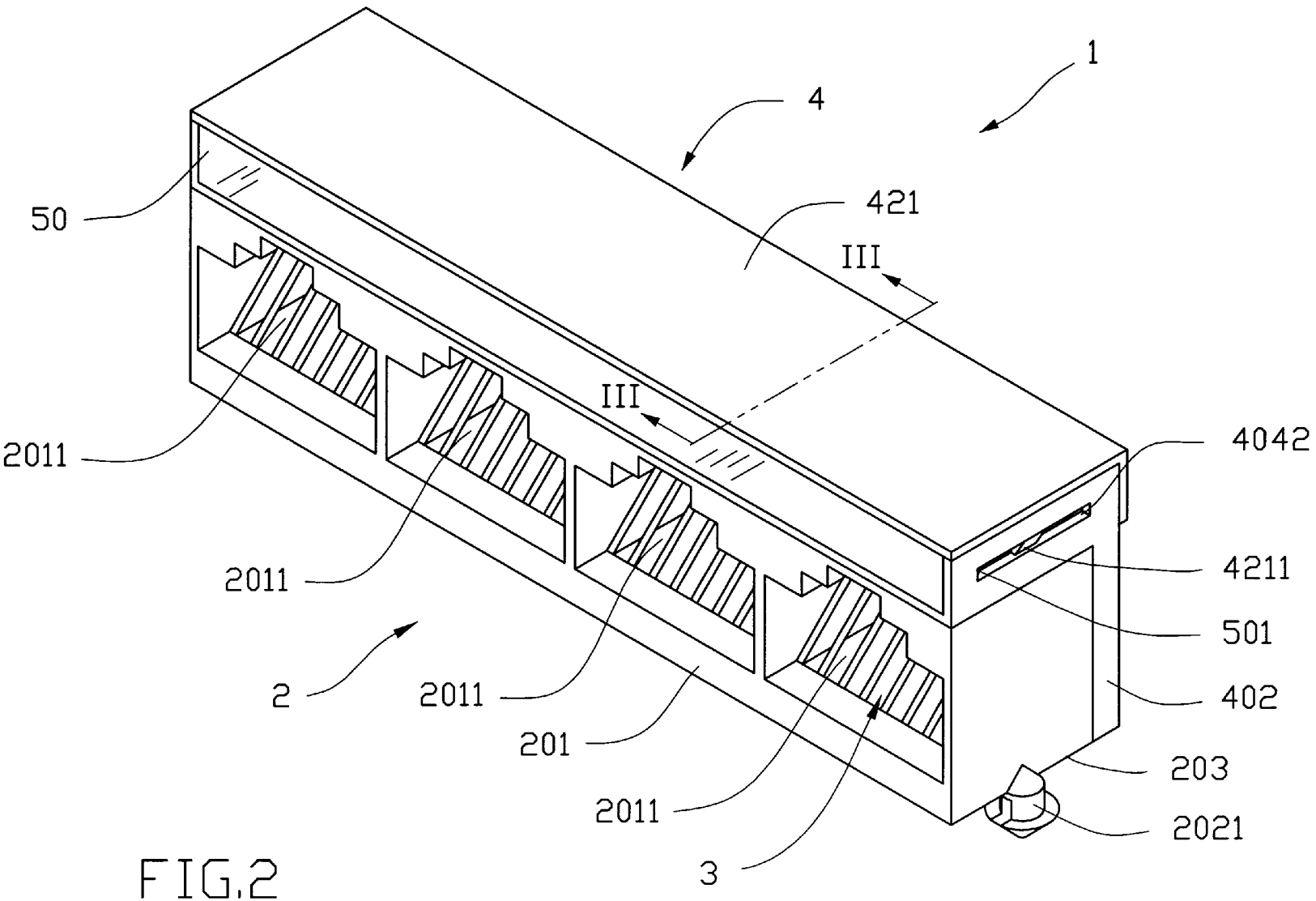
FIG. 2 is a perspective view showing the assembly of the components of FIG. 1.
Figure 3:
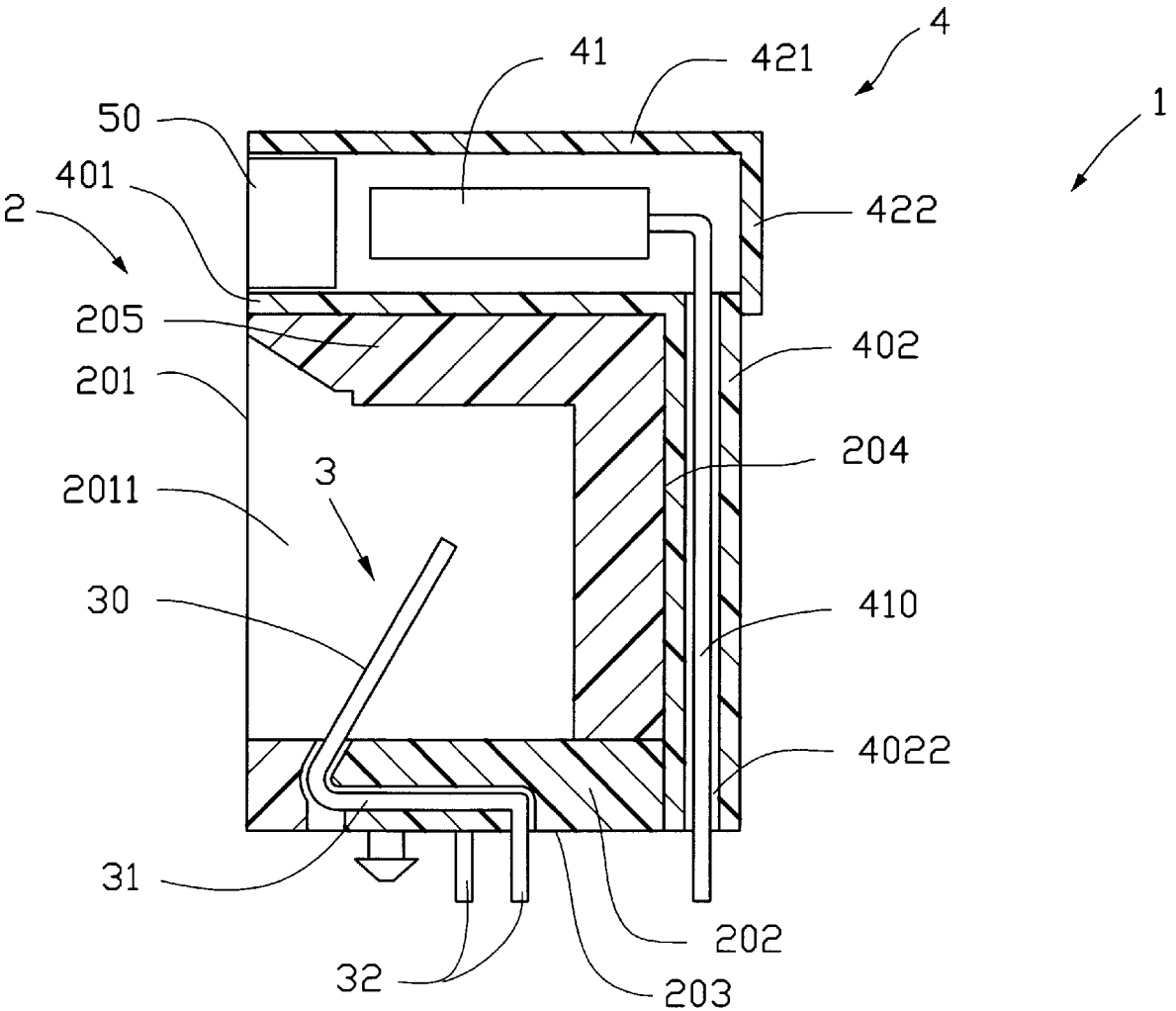
FIG. 3 is a side cross-sectional view of the modular receptacle jack assembly of FIG. 2 taken along line III—III of FIG. 2.

Referring to FIGS. 1 to 3, a modular receptacle jack assembly 1 having a visual indication function in accordance with the present invention includes a modular receptacle jack 2 and an indicator 4. The jack 2 has a housing 20 having a front face 201 defining a number of cavities 2011 for respectively receiving mating modular plug jacks (not shown), a bottom wall 202 having a bottom face 203 for connection to a printed circuit board (not shown), a rear face 204 opposite the front face 201 and a top wall 205 opposite the bottom wall 202. A number of contacts 3 mounted to the horsing 20 each have a fit portion 31 fixedly engaging with the bottom wall 202 of the housing 20, a contact portion 30 extending upward from the bottom wall 202 into a corresponding cavity 2011 in a direction toward the top wall 205 and rear face 204 of the housing 20, and a terminal portion 32 extending downward beyond the bottom face 203 for being soldered to the printed circuit board (not shown). A pair of board locks 2021 (only one being shown) are formed at two sides of the bottom face 203 of the housing 20 and extend downward therefrom to fixedly connect the jack 2 to the printed circuit board. Two depressions 2013 are defined in the top wall 205 of the housing 20.

The indicator 4 in accordance with the present invention consists of a base 40 having a first wall 401, a second wall 402 extending perpendicularly downward from a rear edge of the first wall 401, and a number of partition walls 403 extending upward from the first wall 401 to divide the first wall 401 into a number of regions (not labeled). A number of holes 4022 are defined lengthwise through the second wall 402. Two side walls 404 extend upward from two edges of the first wall 401. Each side wall 404 defines a slot 4042. A pair of first hooks 4012 (only one shown) integrally extend downward from two ends of the first wall 401. A number of light-emitting diodes 41 each have a pair of leads 410 extending in a direction substantially perpendicular to the lighting tube (not labeled) of the diode 41. A cover 42 has a third wall 421 and a fourth wall 422 extending perpendicularly downward from a rear edge of the third wall 421. A pair of second hooks 4211 (only one shown) integrally extend downward from two ends of the third wall 421. An elongated block 50 made of transparent/translucent material forms two protrusions 501 (only one shown) at two lateral ends thereof.

To attach the indicator 4 to the modular receptacle jack 2, the base 40 is first mounted to the jack 2 by extending the first hooks 4012 into the depressions 2013 defined in the top wall 205 of the housing 20 to have an interferential fit therewith, whereby the first wall 401 is fixedly mounted on the top wall 205 and the second wall 402 is attached to the rear face 204 of the housing 20. Thereafter, the leads 410 of each of the diodes 41 are brought to respectively extend through two of the holes 4022 located in a corresponding region defined by the partition walls 403 to reach a position where a bottom portion of the leads 410 extends beyond the bottom face 203 of the modular receptacle jack 2 a distance to facilitate soldering to the printed circuit board (not shown). Since each of the leads 410 has a width which is larger than a diameter of each of the holes 4022, the leads 410 interferentially fit within the second wall 402 and the diodes 41 are fixed in the position shown in FIG. 3. The cover 42 is then brought to be mounted to the base 40 by extending the second hooks 4211 into the slots 4042 to fixedly engage with the side walls 404, whereby the third wall 421 adjoins top edges of the side walls 404 and the fourth wall 422 contacts the second wall 402 to cooperatively define a space (not labeled) in which the diodes 41 are received. Finally, the transparent/translucent block 50 is brought to be assembled with the base 40 by extending the protrusions 501 into a front end of the slots 4042 of the side walls 404 to fixedly engage therewith, whereby a front opening (not labeled) of the space defined between the first and side walls 401, 404 of the base 40 and the third wall 421 of the cover 42 is blocked by the block 50.

From the above description, the indicator 4 constructed in accordance with the present invention is seen to have a simple structure. Furthermore, fixed attachment to an existing modular receptacle jack is easily achieved. Moreover, the modular receptacle jack assembly 1 formed in accordance with the present invention having a visual indication function is compact in volume. Thus, the present invention can overcome the prior art disadvantages.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

It is claimed that:

1. A modular receptacle jack with an indicating function to indicate a connection of the modular receptacle jack with a mating modular plug jack, said modular receptacle jack comprising:

a housing comprising a front face defining a cavity for insertion of the mating modular plug jack, a rear face opposite the front face, a bottom wall having a bottom face for connection to a printed circuit board and a top wall opposite the bottom wall;

a plurality of contacts each having a terminal portion extending beyond the bottom face of the housing for connection with the printed circuit board, a fitting portion securely fixed to the bottom wall, and a contact portion extending upwardly from the bottom wall into the cavity and in a direction toward the top wall and the rear face of the housing; and a discrete indicator mounted to the top wall of the modular receptacle jack, said indicator comprising:

a base having a first wall attached to the top wall of the housing, a second wall extending substantially perpendicular to the first wall and attached to the rear face of the housing; and a light-emitting device mounted on the first wall of the base and having conductive wires extending along the second wall of the base;

the light-emitting device being a light-emitting diode, said first wall further having two side walls extending upwardly from two edges thereof in a direction opposite the second wall, and the indicator further comprising a cover having a third wall adjoining the side walls and a fourth wall contacting the second wall to define a space therebetween in which the light-emitting diode is received; wherein each side wall defines a slot, and a third wall forms a pair of first hooks each extending through one corresponding slot to securely connect with one corresponding side wall.

2. The assembly in accordance with claim 1, wherein the conductor wires interferentially engage with the second wall of the base.

3. The modular receptacle jack in accordance with claim 1, wherein the first wall of the base forms a second hook interferentially extending into a depression defined in the top wall of the housing to fixedly engage therewith, whereby the base of the indicator is fixedly mounted to the top wall of the housing of the modular receptacle jack.

4. The modular receptacle jack in accordance with claim 1 further comprising a transparent/translucent block located between the first and side walls of the base and the third wall of the cover to block a front opening defined by the space in which the diode is received.

5. The modular receptacle in accordance with claim 1 further comprising a partition wall extending from the first wall toward the third wall and located between the two side walls, and wherein the diode is located between the partition wall and one of the side walls.

6. The modular receptacle in accordance with claim 4, wherein the transparent/translucent block comprises a protrusion located at an end thereof, said protrusion extending into a corresponding one of the two slots defined by the two side walls to fixedly engage with a corresponding one of the two side walls.

7. The modular receptacle in accordance with claim 1 further comprising a board lock extending downward from the bottom face of the bottom wall of the housing for fixedly engaging with the printed circuit board.

8. The modular receptacle in accordance with claim 1, wherein the second wall comprises two holes extending therethrough, and the light-emitting device has two conductive wires extending through the two holes defined in the second wall of the base and interferentially engaging therewith.

* * * * *